US007806403B2

(12) United States Patent
Matsui

(10) Patent No.: US 7,806,403 B2
(45) Date of Patent: Oct. 5, 2010

(54) SHEET CONVEYING APPARATUS AND IMAGE FORMING APPARATUS

(75) Inventor: Noriaki Matsui, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/275,828

(22) Filed: Nov. 21, 2008

(65) Prior Publication Data

US 2009/0134569 A1 May 28, 2009

(30) Foreign Application Priority Data

Nov. 27, 2007 (JP) ..... 2007-305590

(51) Int. Cl.
*B65H 7/02* (2006.01)

(52) U.S. Cl. ..... 271/227

(58) Field of Classification Search ..... 271/226–252
See application file for complete search history.

(56) References Cited

U.S. PATENT DOCUMENTS 6,324,355 B1 11/2001 Matsui et al. ..... 399/38
6,330,404 B1 12/2001 Munenaka et al. ..... 399/51
6,637,634 B1 * 10/2003 Yeo et al. ..... 226/42
2006/0163801 A1 * 7/2006 Dejong et al. ..... 271/227
2007/0296141 A1 * 12/2007 Inoue ..... 271/226
2008/0309006 A1 * 12/2008 Iguchi et al. ..... 271/227
2009/0033026 A1 * 2/2009 Fuchi ..... 271/227
2009/0278305 A1 * 11/2009 Takemura ..... 271/228

FOREIGN PATENT DOCUMENTS

JP 5-124752 5/1993
JP 10-310288 11/1998
JP 2000-289889 10/2000

* cited by examiner

*Primary Examiner*—Patrick Mackey
*Assistant Examiner*—Prasad V Gokhale
(74) *Attorney, Agent, or Firm*—Fitzpatrick, Cella, Harper & Scinto

(57) ABSTRACT

A sheet conveying apparatus includes a sheet conveying part that conveys sheets; a detection part that outputs a signal according to a position of each sheet conveyed by the sheet conveying part in a lateral direction orthogonal to a conveying direction; a lateral shift part that shifts the conveyed sheet in the lateral direction; and a control part that controls an operation of the lateral shift part based on an output of the detection part. Then, after lateral shift operation is ended by the lateral shift part, detection is performed again by the detection part, and based on a detection result thereof, the control part controls an operation of the lateral shift part so that the conveyed sheet is shifted again in the lateral direction.

8 Claims, 19 Drawing Sheets

NIP STATE IN CASE OF D-CUT ROLLER

NIP RELEASE STATE IN CASE OF D-CUT ROLLER

NIP STATE IN CASE OF DESORPTION ROLLER

NIP RELEASE STATE IN CASE OF DESORPTION ROLLER

SHEET CONVEYING APPARATUS AND IMAGE FORMING APPARATUS

BACKGROUND OF THE INVENTION

1. Field of the Invention

The present invention relates to a sheet conveying apparatus that conveys sheets and an image forming apparatus provided with the sheet conveying apparatus.

2. Description of the Related Art

In an image forming apparatus, when a skewed sheet feeding occurs, a correct image can not be formed on each sheet. Therefore, conventionally the image forming apparatus has a sheet registration correcting mechanism for correcting a skewed sheet, when skew feeding of the sheet to be conveyed occurs.

In a conventional sheet registration correction, there is a method of correcting the skewed sheet (called a skew correction hereafter) in which two rollers are used to be independently driven, thereby giving a relative speed difference to the rollers. Also, there is a method of correcting the skewed sheet by butting tips of paper sheets, on one side of its vertical surface in a conveying direction (called a skew feed butting correction). Further, generally there are various methods such as obviating the skew feeding by forming the tips of the sheets into a loop state, as illustrated in a registration roller.

As general applications, skew feed butting correction and skew correction are performed to enable print-on-demand image to be formed, from the viewpoint of high precision+ high productivity. In addition, from the viewpoint of miniaturization of an apparatus body, the skew correction is advantageous in structure. However, particularly in the skew correction, when a conveyed sheet is shifted in a direction orthogonal to a conveying direction (lateral direction), in order to correct such a shift, sheet lateral registration correction needs to be performed separately. In this case, generally a flow of correcting lateral registration is as follows. Namely, sheet tip registration correction is performed first, and then sheet lateral registration correction is performed.

For example, Japanese Patent Application Laid-Open No. 05-124752 and Japanese Patent Application Laid-Open No. 2000-289889 propose a technique in which a lateral registration of the sheet is detected and according to an amount of detection, the sheet is laterally shifted. According to Japanese Patent Application Laid-Open No. 05-124752, the lateral registration of the sheet is detected in such a manner that a lateral tip of the sheet is detected by a line sensor such as contact image sensor, and a sheet lateral shift amount is detected. Then, the sheet lateral registration is corrected in such a manner that a roller itself conveying the sheet is moved in a direction orthogonal to the conveying direction (=the sheet itself is laterally moved) by an amount according to a detected sheet lateral shift amount.

In addition, as illustrated in Japanese Patent Application Laid-Open No. 10-310288, there is a proposal that by disposing a sensor at a sheet side edge reference position, a sheet side edge is aligned with a sheet side edge reference. This is a technique of correcting the sheet lateral registration by moving the roller itself conveying the sheet, in a direction perpendicularly to the conveying direction.

The documents provide a technique of aligning the sheet with a formed image by laterally moving the sheet itself, as a lateral registration correction part of the sheet. The detection itself includes the detection for deciding a moving amount and the detection for deciding a completion of movement.

However, according to a conventional technique, the lateral registration of the sheet is corrected by laterally shifting the conveying roller. However, this conventional technique involves problems such as described below.

For example, from the viewpoint of a mechanical restriction and productivity, in a sheet lateral registration shift area, the lateral shift of a pair of lateral shift rollers, with a sheet nipped between them, can not occur at a timing of pass of the sheet tips. Therefore, the lateral shift of the sheet lateral registration shift area is performed in many cases, at a timing when the tip of the sheet is conveyed by predetermined amounts after passing through the pair of the lateral shift rollers.

In such a case, for example as illustrated in FIG. 19, when it is assumed that the lateral shift is performed at a position advancing by ¼ of a sheet size A in the conveying direction (broken line in the figure) from the tip of the sheet, no particular problem is involved in the case of a sheet size A. However, in the case of a sheet size B (solid line in the figure) having a greater length than that of the sheet size A in the conveying direction, the lateral shift is performed at the tip side of the sheet. If the length of the size B in the conveying direction is twice the length of the size A, as illustrated in FIG. 19, the following equation is established:

(lateral shift roller from tip of sheet):(rear tip of sheet from lateral shift roller)=1:7

This reveals that lateral shift rollers 31 perform lateral shift, with sheet nipped between them, at a position extremely closer to the tip portion of the sheet.

Therefore, a lateral shift force is added to only the tip portion of the sheet in a direction X orthogonal to a conveying direction Y, and absolutely no force is added to the rear tip portion of the sheet in the direction X, to set this portion in a free state. Actually, the force added to the sheet in the direction X is unbalanced if the lateral shift is performed with the sheet nipped between the pair of the lateral shift rollers at a biased position as described above, due to a friction and air resistance between the sheet and a conveying path. As a result, accurate lateral shift control is difficult.

Thus, in the case of the structure that "the lateral shift correction is performed always at a predetermined timing from the tip of the sheet irrespective of a sheet size", the shift force added to the sheet is unbalanced, thus generating a slip, and a stable correction can not be performed. Therefore, there is a problem that the sheet is skewed in some cases.

Note it can be considered that when the lateral shift rollers 31 are disposed at two places of the tip side and the rear tip side in the conveying direction.

And it can be also considered that when the center part of the sheet in the conveying direction is nipped between the lateral shift rollers, a lateral shift operation is started. However, when the lateral shift rollers 31 are disposed at two places of the tip side and the rear tip side in the conveying direction or the lateral shift operation is started with the center part of the sheet nipped by the pair of the lateral shift rollers, a stable correction of a sheet position can not be performed by generating a slip between the lateral shift rollers 31 an the sheet due to a friction between the sheet and the conveying path while the lateral shift rollers 31 is shifting the sheet.

SUMMARY OF THE INVENTION

The present invention provides a sheet conveying apparatus capable of surely performing a lateral shift of a sheet with high accuracy and an image forming apparatus.

In order to solve the above-described problems, the present invention provides the sheet conveying apparatus typically having a structure described below.

There is provided the sheet conveying apparatus, including: a sheet conveying part that conveys a sheet; a detection part that outputs a signal according to a position of the sheet conveyed by the sheet conveying part, in a lateral direction orthogonal to a conveying direction; a lateral shift part that shifts a conveyed sheet in the lateral direction; and a control part that controls an operation of the lateral shift part based on an output of the detection part, wherein after the lateral shift operation by the lateral shift part is ended, detection by the detection part is performed again, the control part controls the operation of the lateral shift part based on the detection result.

According to the present invention, by performing a positional correction in the lateral direction of the sheet multiple numbers of times, a reliable correction can be performed for particularly a long sheet requiring large variation of the correction.

Further features of the present invention will become apparent from the following description of exemplary embodiments with reference to the attached drawings.

DESCRIPTION OF THE EMBODIMENTS

Next, a sheet conveying apparatus according to one embodiment of the present invention is described, together with an image forming apparatus provided with the sheet conveying apparatus.

First Embodiment

Figure 1:
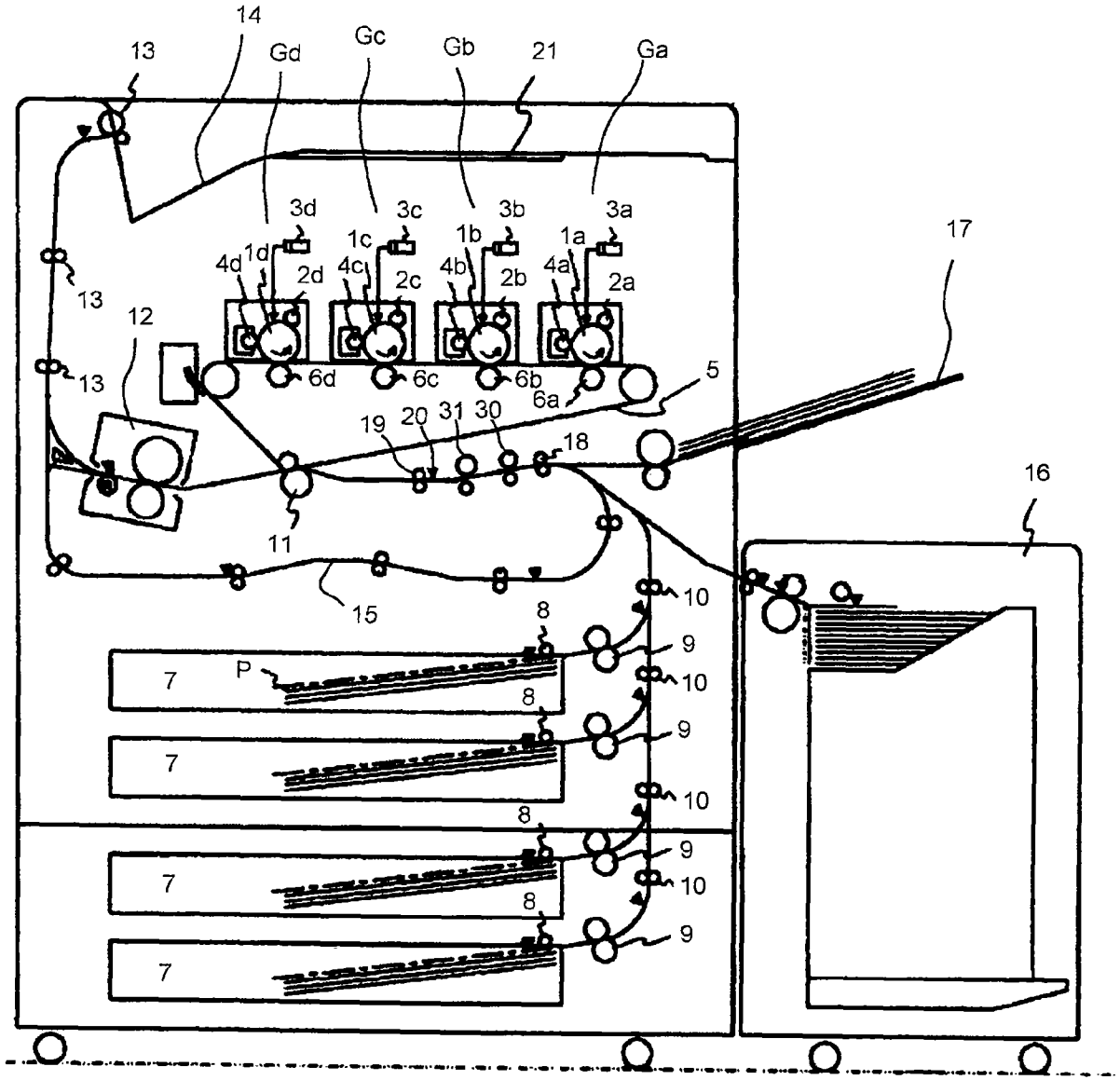
FIG. 1 is a sectional view of an image forming apparatus according to an embodiment of the present invention.

FIG. 1 is an overall sectional explanatory diagram of the image forming apparatus according to a first embodiment of the present invention.

[Overall Structure of Image Forming Apparatus Provided with Sheet Conveying Apparatus]

First, an overall structure of the image forming apparatus of this embodiment will be described with reference to FIG. 1, together with an image forming operation. In the image forming apparatus of this embodiment, image forming parts Ga, Gb, Gc, and Gd for forming a toner image of each color of yellow, magenta, cyan, and black are disposed in an upper part of an apparatus body. Each one of the image forming parts Ga, Gb, Gc, and Gd has the same structure excluding a point that toner color is different. Therefore, unless there is no particular distinction required, suffixes a, b, c, d given to the figure to show the element provided for any one of the colors, are omitted and description will be given as a whole.

Each image forming part G forms an electrostatic latent image by uniformly charging a rotating photosensitive drum 1 by a charging roller 2 and irradiating the photosensitive drum 1 with light from a laser scanner 3 in accordance with an image signal. This electrostatic latent image is made visible by being developed by toner using a development device 4.

An endless intermediate transfer belt 5 is rotatably abutted on each photosensitive drum 1. Then, as described above, the toner image formed on each photosensitive drum 1 is transferred to the intermediate transfer belt 5 in an overlapped state by applying bias voltage to a primary transfer roller 6, thereby forming a color image.

The sheet conveying apparatus is disposed in the lower part of the image forming part G, and a sheet P is conveyed to an image transfer part in synchronization with formation of the above toner image. Specifically, sheets contained in a sheet cassette 7 are separated one by one and conveyed by sheet feeding rollers 8, separating rollers 9, and a pair of conveying rollers 10. Then, by a pair of registration rollers 19, the conveyed sheet is conveyed to a secondary transfer part, being a nip part between a secondary transfer roller 11 and the intermediate transfer belt 5, in synchronization with formation of the image. In the secondary transfer part, the toner image on the intermediate transfer belt 5 is transferred to the conveyed sheet P by applying bias voltage to the secondary transfer roller 11.

Further, the sheet P, with the toner image transferred thereto, is conveyed to a fixing device 12, and the toner image heated and pressurized here is fixed to the sheet, and thereafter is discharged to a discharging part 14 by a pair of discharge rollers 13.

Note that when recording is performed to both sides of the sheet, the sheet, with image formed on one side as described above, is conveyed to a reverse conveying path 15 by switchback, and the sheet is conveyed to the image forming part G again to form an image on the other side and discharged thereafter.

In addition, in the image forming apparatus of this embodiment, a feeding deck 16 can be attached thereto, so that large volume of sheets can be fed, and also the sheet of an arbitrary size can be fed from a manual feeding part 17.

Figure 2:
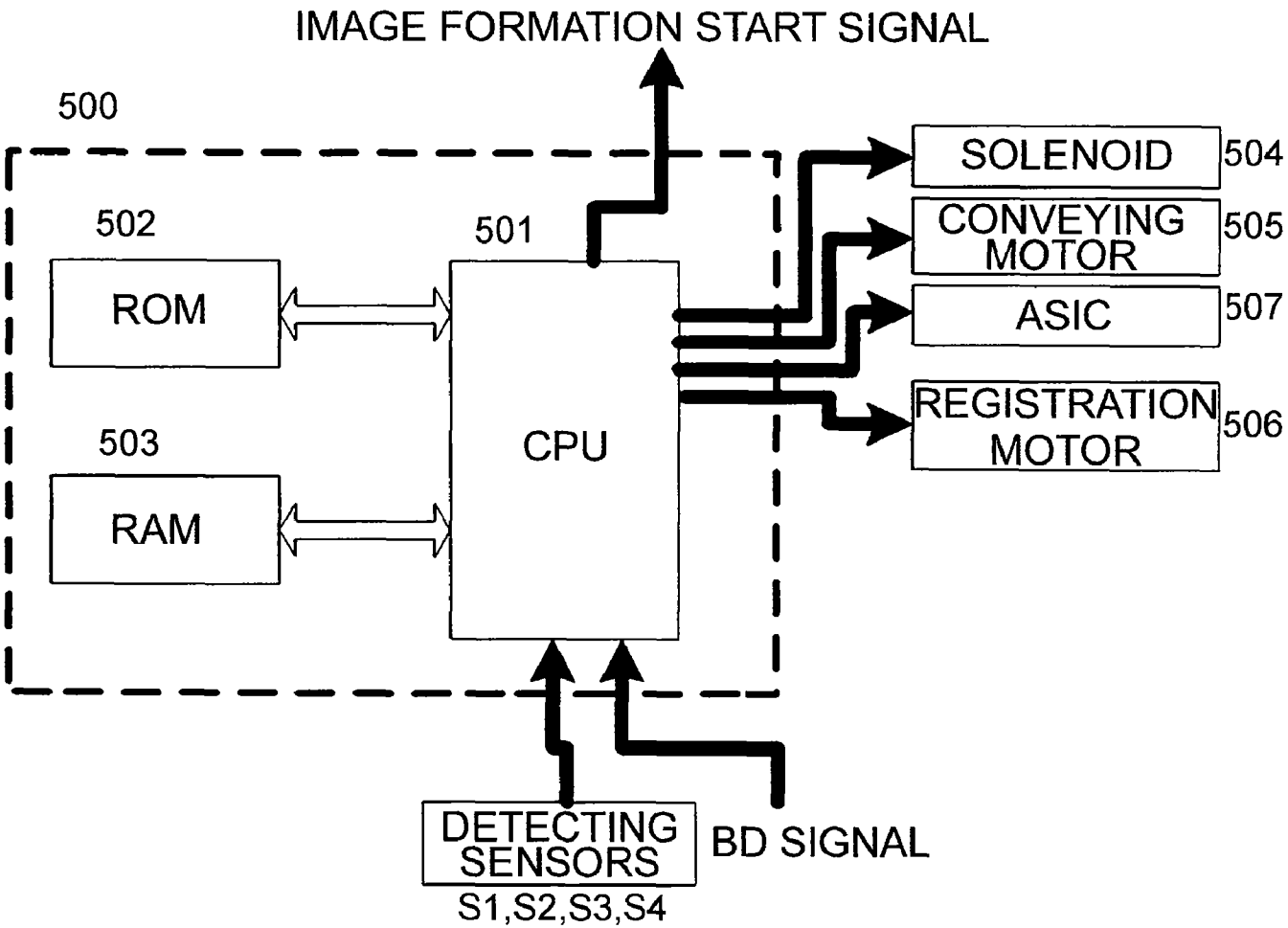
FIG. 2 is a block diagram of a control unit.

The image forming apparatus according to this embodiment is controlled by a control unit 500 illustrated in FIG. 2. In FIG. 2, reference numeral 501 indicates a CPU, being a control part, reference numeral 502 indicates an ROM, and reference numeral 503 indicates an RAM. Also, reference numeral 504 indicates a solenoid for operating a conveying path switching member, reference numeral 505 indicates a conveying motor for driving the feeding rollers and the conveying rollers for conveying the sheet, and reference numeral 506 indicates a registration motor for rotating a pair of registration rollers 19.

The control unit 500 includes a control substrate (not illustrated) for controlling an operation of a mechanism in the above each unit, and includes a motor drive substrate (not illustrated).

Note that FIG. 2 is a view illustrating only a necessary block for describing the characteristic of this embodiment.

The CPU 501 performs overall control of the image forming apparatus. Control programs are stored in the ROM 502, and temporary data necessary for control is stored in the RAM 503, and is appropriately read out.

The CPU 501 has a plurality of timers inside, and a BD signal is counted by one of the timers to generate a predetermined timing. Also, by using another timer, an internal clock of the CPU 501 is counted to generate a predetermined timing.

In addition, the CPU 501 outputs an image formation start signal. By the output of the image formation start signal, image exposure is started.

In addition, each kind of sensors S1 to S4 as will be described later for detecting the conveyed sheet are disposed on the sheet conveying path. Then, the CPU inputs a detection signal from the sensors S1 to S4, and based on the detection result, performs drive-control of the registration motor 506 and the conveying motor 505, to control sheet conveyance.

After predetermined number of counts of the BD signals is performed from the start of the image exposure, the registration motor 506 is driven to rotate the pair of registration rollers 19. Meanwhile, when a sheet conveying operation is started after elapse of proper time from the start of the image exposure, in time for the start of rotary drive of the pair of the registration rollers 19, the image and the sheet can be synchronized with each other.

In addition, according to this embodiment, the CPU 501 and ASIC 507 are bus-connected to each other, and exchange of data is performed by a bus signal.

Figure 3:
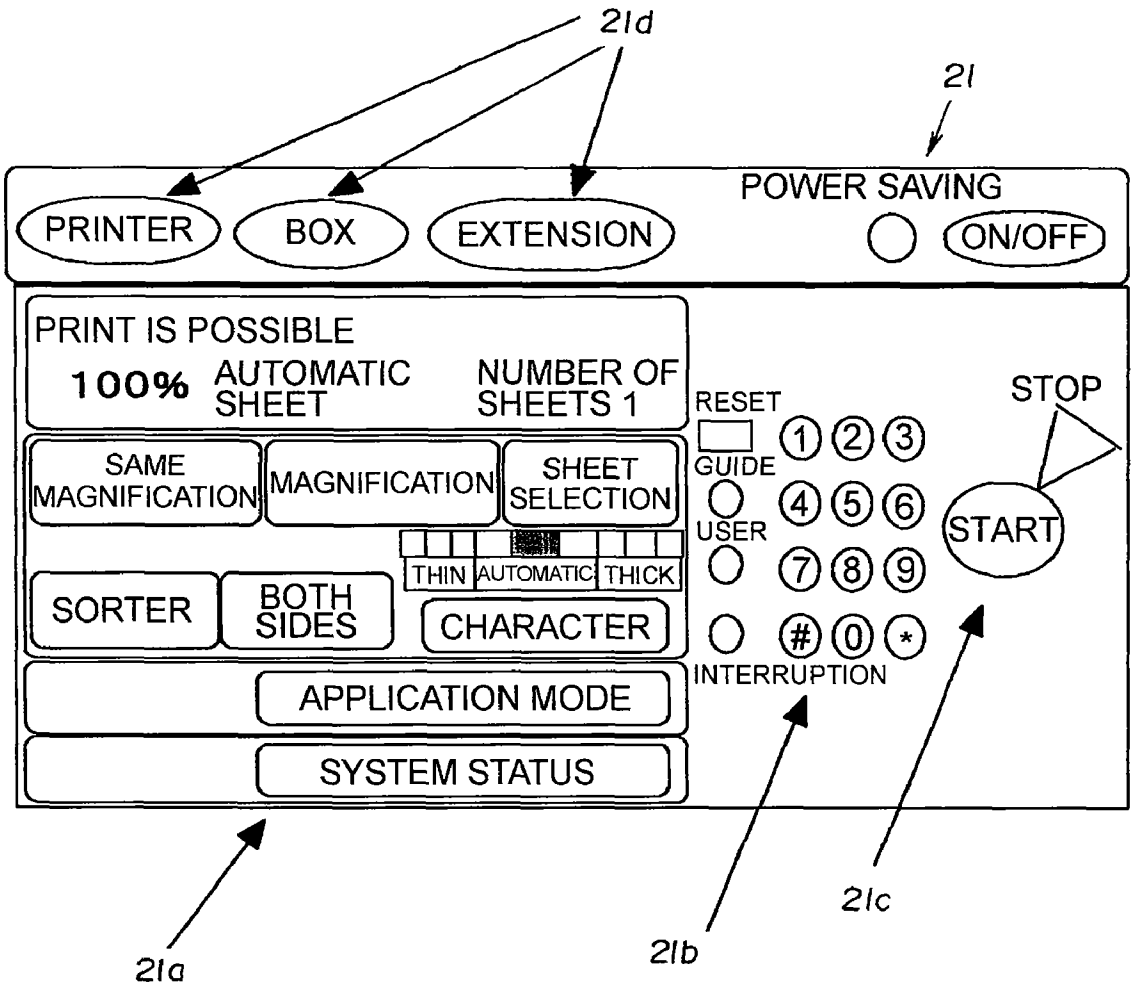
FIG. 3 is an explanatory diagram of an operation portion according to the embodiment of the present invention.

FIG. 3 is a planar explanatory diagram of an operation portion 21 for designating the operation of the image forming apparatus. The operation portion 21 is disposed on an upper surface of the image forming apparatus. In FIG. 3, reference numeral 21*a* indicates a display part to display an operation status/message thereon. In addition, the surface of the display part 21*a* is formed into a touch panel, and by touching on the surface, the touch panel functions as a selection key, and magnification setting is performed here. Reference numeral 21*b* indicates a key pad, being keys for inputting numerals, and print setting to the printer is performed here. Reference numeral 21*c* indicates a start key, and by depressing the key, print operation is started. Also, reference numeral 21*d* indicates a function key, capable of switching printer operation, BOX operation, and extended functions through one-touch operation. Among the operations, by the BOX operation, the image can be accumulated in a hard disc part (not illustrated) prepared in a body of the image forming apparatus.

[Lateral Shift Part]

In the sheet conveying apparatus according to this embodiment, lateral shift rollers 31 and skew rollers 30 constituting a "lateral registration shift part" are provided between a pair of front rollers 18 and a pair of registration rollers 19 illustrated in FIG. 1. When the sheet is conveyed in such a manner as shifting from a reference position in a direction (lateral direction) orthogonal to the conveying direction, the lateral registration shift part detects the shift amount, then shifts the sheet in the lateral direction, and returns the sheet to a normal reference position.

Figure 4:
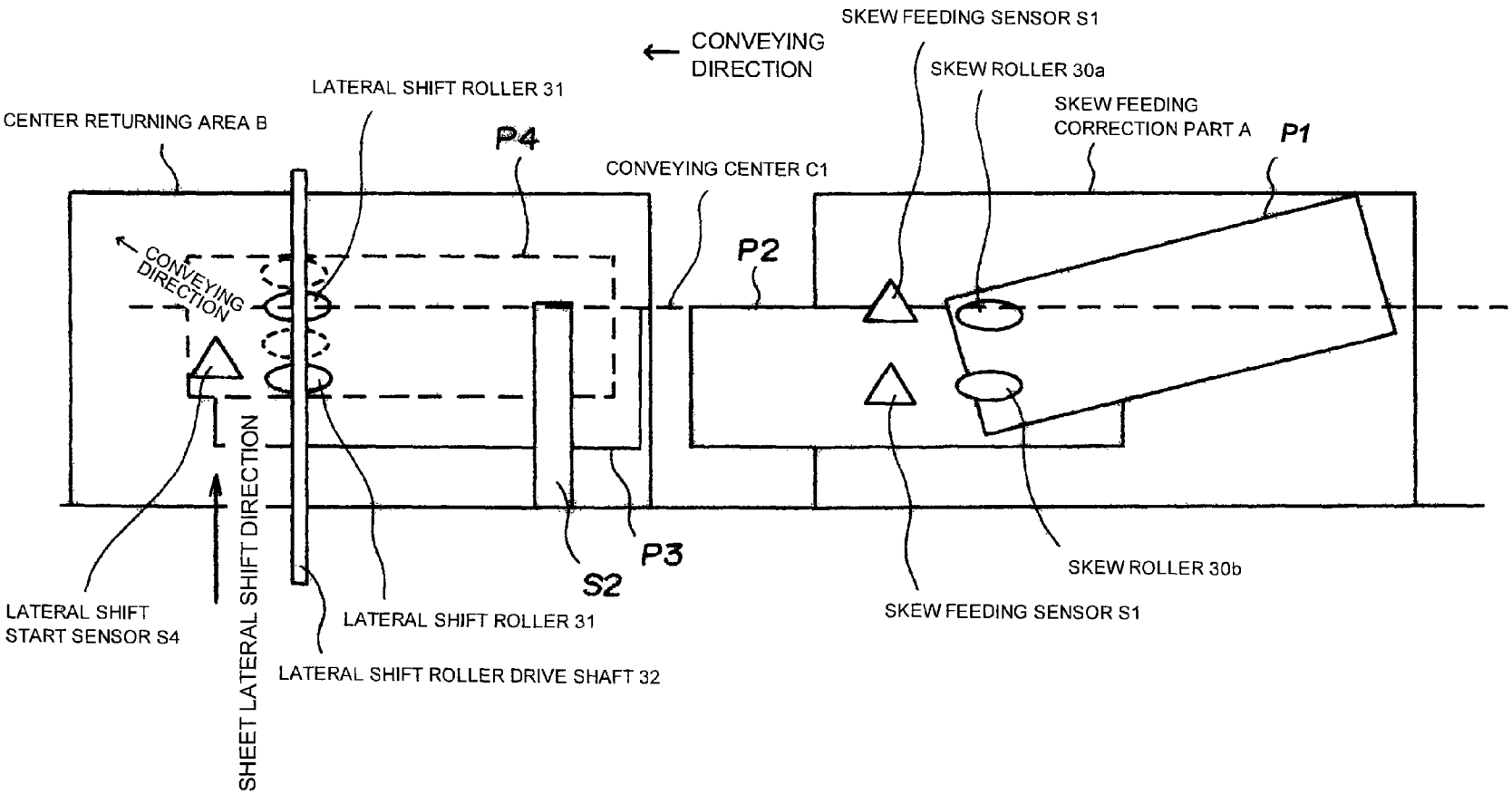
FIG. 4 is a configuration diagram of registration correction according to the embodiment of the present invention.

FIG. 4 illustrates a constituent part of the lateral registration shift part, and a skew feeding correction part A and a center returning area B are provided in the conveying direction of the sheet.

(Skew Feeding Correction Part)

The skew feeding correction part A is a part for correcting a skew feeding state of a sheet P1 in parallel to the conveying direction. Namely, a skew feeding amount of the sheet P1 in the skew feeding state is recognized by two skew feeding sensors S1, at a time difference of ON detection of the tips of the sheets. Then, according to the skew feeding amount, in two independently driven skew rollers 30 (30*a*, 30*b*), the speed of one of them related to the preceding tip of the sheet is reduced for a specific length of time. Thus, the preceding tips of the sheets are aligned with delayed tips of the sheets. A value of the specific length of time is decided according to the skew feeding amount.

As illustrated in FIG. 4, a sheet P2 passed through the skew feeding correction part A is set in a state in which the skew feeding is corrected. However, in an example of FIG. 4, the sheet P2 is in a state of being shifted from a conveying center C1, being a reference position of conveying the sheet P2. The conveyed sheet is returned to the center by a center returning area.

(Center Returning Area)

Figure 5:
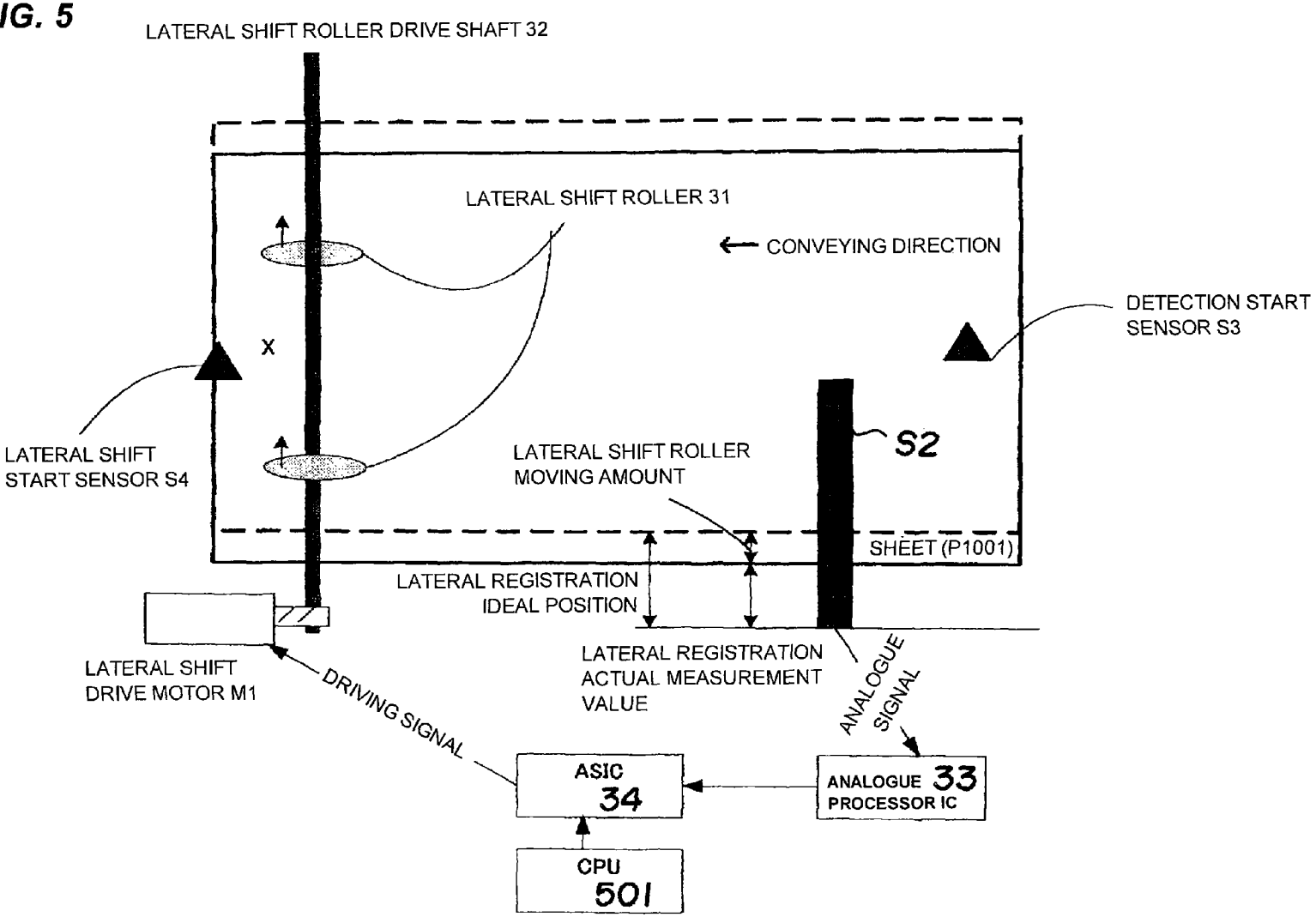
FIG. 5 is a configuration diagram of a lateral registration correction according to the embodiment of the present invention.

Next, the center returning area B is described by using FIG. 5. The center returning area B includes a lateral registration detection part (detection part) for detecting the shift amount of the sheet conveyed by the sheet conveying part that conveys the sheet, which is shifted in the lateral direction orthogonal to the conveying direction. Also, the center returning area B includes a lateral shift part for moving the lateral shift rollers 31, being moving members that exist at a home position, based on the detection result of the lateral registration detection part and returning the lateral shift rollers 31 to the home position after allowing the conveyed sheet to shift in the lateral direction.

Also, there are provided a lateral registration detecting sensor S2 for detecting an edge of the sheet in the lateral direction, with the skew feeding corrected by the skew feeding correction part A as described above, and a lateral registration detection start sensor S3 for detecting arrival of the tips of the sheets, being a reference for deciding a detection timing of the edge. In addition, there are provided the lateral shift rollers 31 for correcting the shift of the sheet in the lateral direction (direction X) after detecting the lateral registration of the sheet, in accordance with amount and direction of the detection, and a lateral shift start sensor S4, being a lateral shift start detection part that detects the arrival of the tips of the sheets, being the reference for deciding the timing of shift of the lateral shift rollers 31.

The sheet, with the skew feeding corrected, enters the center returning area B. In the center returning area B, the lateral registration of the sheet P3 is measured by the lateral registration detecting sensor S2 constituted of a line sensor such as a contact image sensor, being the lateral registration detection part (detection part). Then, the lateral shift rollers 31 on the lateral shift roller drive shaft 32 are moved to a direction orthogonal to the conveying direction of the sheet, to thereby move the sheet to a state of P4 depending on the measured lateral registration. Thus, the center of the sheet P4 is aligned with a conveying center C1 to convey the sheet in the sheet conveying direction.

In the flow of the control, a lateral registration position of the conveyed sheet is detected by the lateral registration detecting sensor S2, and is subjected to A/D conversion processing by an analogue processor IC33. Thereafter, a difference between a lateral registration detected position and a lateral registration ideal position previously set is subjected to the processing of converting it to the lateral shift amount of the lateral shift rollers 31 by a lateral registration detecting/correcting control part such as an ASIC 34. Based on such a conversion processing, the lateral registration of the sheet is corrected by outputting the lateral shift amount to a lateral shift drive motor M1 as a drive signal.

(Lateral Registration/Correction Control Part)

Figure 6:
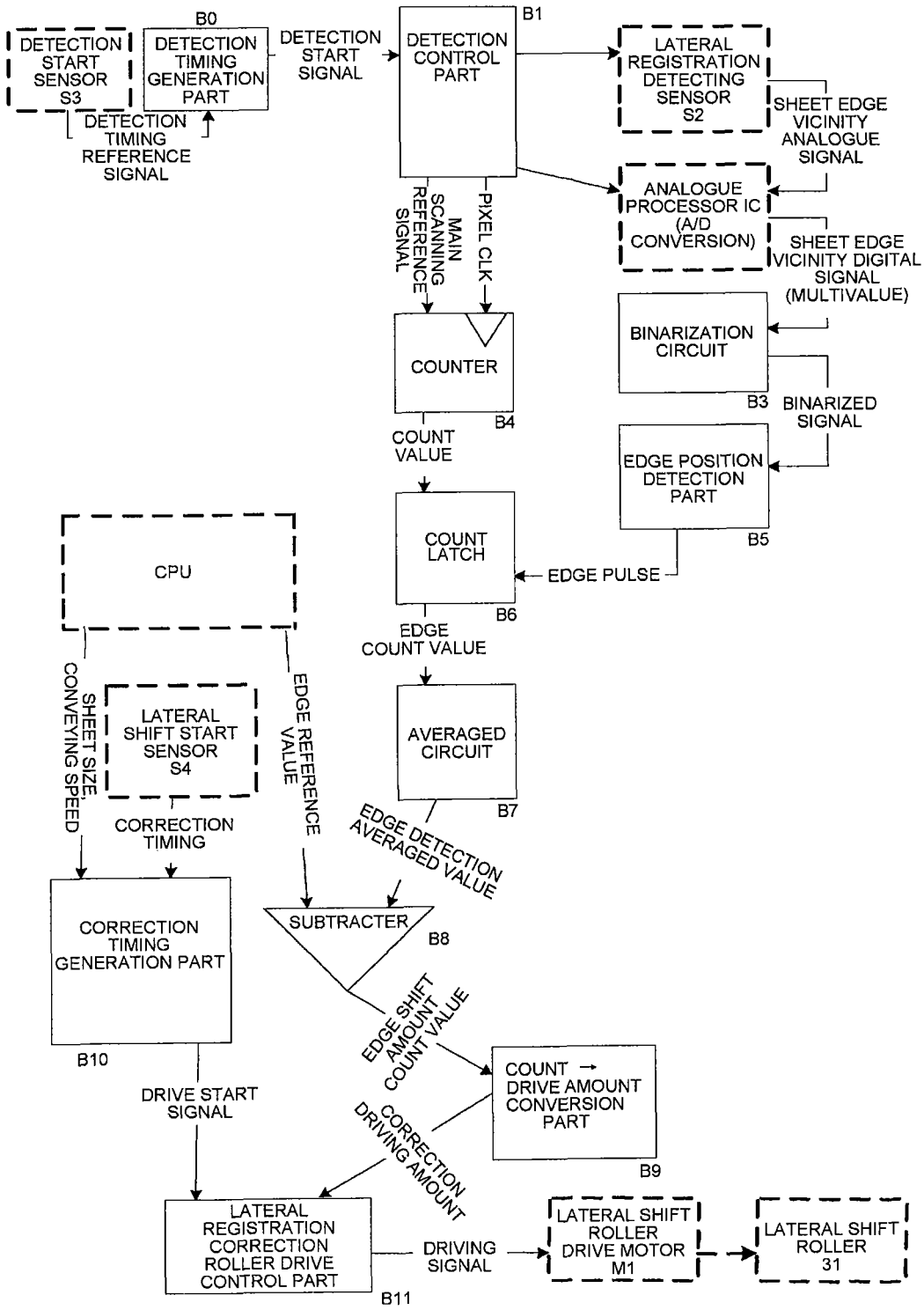
FIG. 6 is a block diagram of correcting the lateral registration according to the embodiment of the present invention.

Next, the structure of a lateral registration detecting/correcting control part is described with reference to a control block diagram of FIG. 6. Note that blocks illustrated by solid lines of FIG. 6 are constituted within the ASIC 34 as illustrated in FIG. 5, and the blocks illustrated by broken lines of FIG. 6 are constituted in a place other than the ASIC.

First, a detection control part B1 performs detecting operation based on a detection start signal generated from a detection timing generation part B0 from an input of a detection timing reference signal of the lateral registration detection start sensor S3. The value of the lateral registration detecting sensor S2 under the control of the detection control part B1, is A/D converted in the analogue processor IC33 and is subjected to binarization processing in a binarization circuit B3. A threshold value at this time is changed by the CPU 501 depending on the type of the sheet. Based on the binarized signal, an edge pulse is generated in an edge position detection part B5 as a latch signal of a count latch part B6.

Meanwhile, a counter B4 for counting a driving clock (≈pixel CLK) from the detection control part B1 is cleared per every main scanning synchronization signal. Namely, the number of pixels of the lateral registration detecting sensor S2 (resolution is decided by the line sensor) is counted. The count value is latched in a count latch part B6 at a timing of the latch signal, and is input in a subtracter B8 through an averaging circuit B7 as a sheet edge count value.

An edge reference value from the CPU 501 is also input in the subtracter B8, and a difference between the sheet edge count value and the edge reference value is output as the shift amount of the edge, and a sign of the difference is output as a shift direction. The edge shift amount is converted in a count→ driving amount conversion part B9, to a correction driving amount of the lateral shift rollers 31 by table or calculation, and is input in a lateral registration correction roller drive control part B11.

Meanwhile, by a correction timing generation part B10, a drive start signal is input in the lateral registration correction roller drive control part B11, so as to be delayed from a correction timing reference signal sent from the lateral shift start sensor S4, based on conveying speed information and sheet size information obtained from the CPU 501. For example, when the lateral registration shift is started at a center position of the sheet in the conveying direction, and the conveying speed is set at PS(mm/s) and the sheet size in the conveying direction is set at S(mm), the above delay time T[s] is decided as follows.

$$T=\{(S/2)-\alpha\}/PS \quad (1)$$

wherein α is a distance (mm) from the lateral shift rollers 31 to the lateral shift start sensor S4.

In addition, when the lateral registration shift operation is performed immediately at the timing of the correction timing reference signal from the lateral shift start sensor S4, the above formula is treated as a fixed value such as T=0.

The lateral registration correction roller drive control part B11 generates the drive signal according to the above correction driving amount, with the drive start signal generated at the above timing as a trigger, and decides a driving direction of the lateral shift drive motor M1, according to positive data/negative data of the correction driving amount. In addition, the lateral registration correction roller drive control part B11 decides the driving time of the lateral shift drive motor M1 according to the correction driving amount, and performs the lateral shift of the lateral shift rollers 31.

Thus, at a timing when the lateral shift rollers 31 arrive at a predetermined position of the sheet of each size, the lateral shift correction operation is performed.

(Drive of Lateral Shift Drive Motor)

Next, description will be given for the operation of the lateral shift drive motor at the time of the lateral shift correction operation as described above, by using FIG. 7 to FIG. 9.

Figure 7:
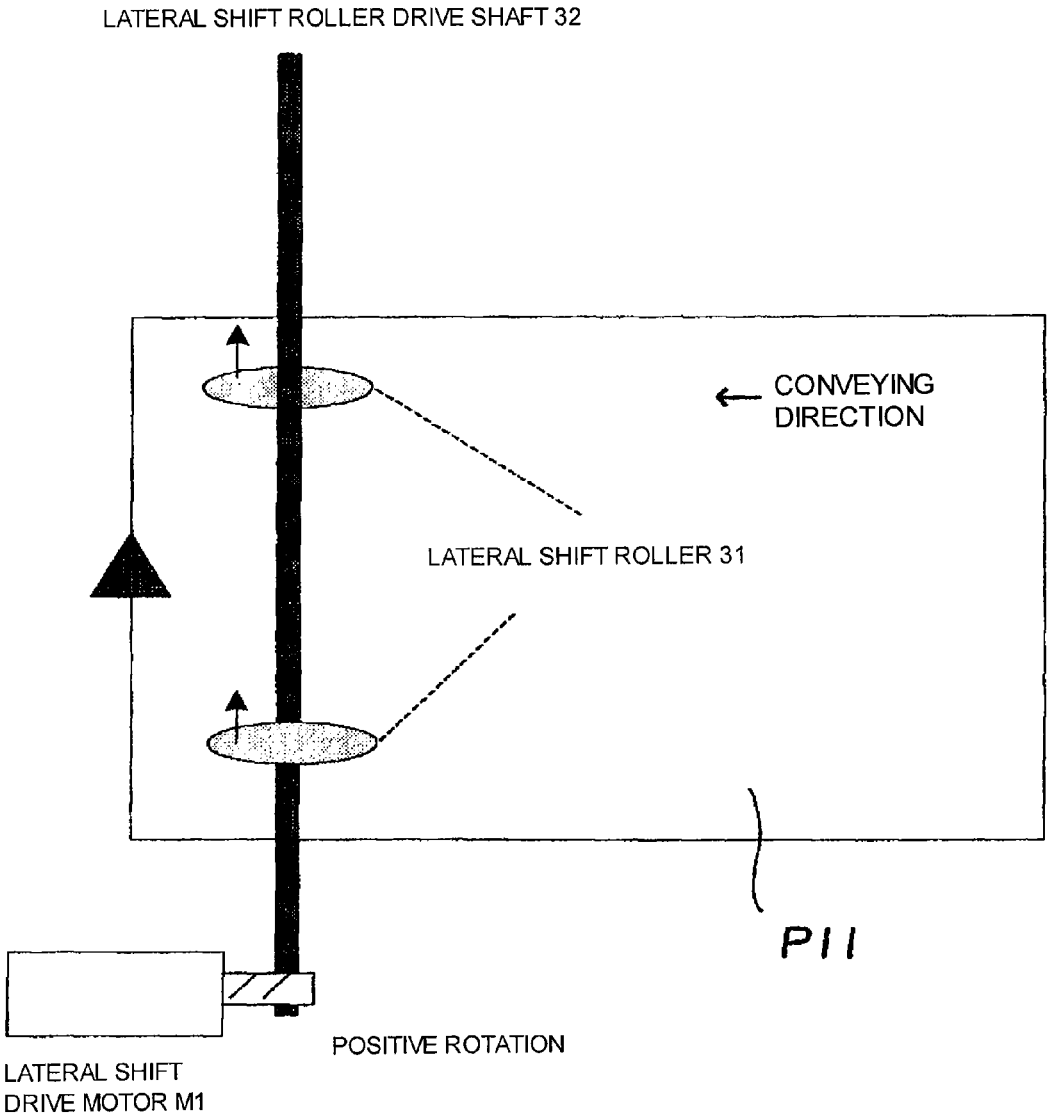
FIG. 7 is an explanatory diagram illustrating an example of an operation in a case of correcting the lateral registration according to the embodiment of the present invention.

First, in FIG. 7, the lateral shift drive motor M1 is positively rotated (or reversely rotated) according to a moving amount of the above lateral shift rollers 31, and is driven by a predetermined amount. In an example illustrated in FIG. 7, by performing positive rotation, the lateral shift rollers 31 are moved in a direction illustrated by arrow. In addition, the sheet P11 at this time is conveyed in the conveying direction of the sheet.

Figure 8:
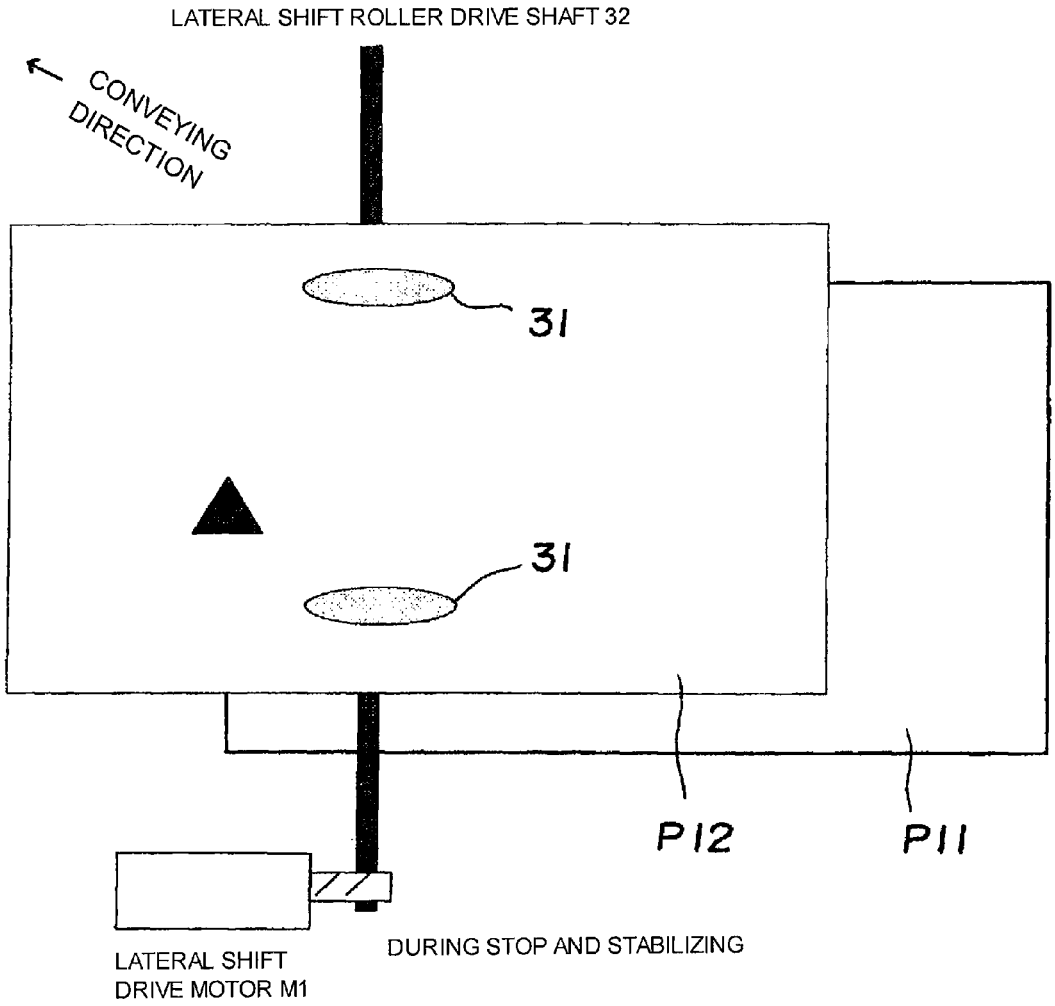
FIG. 8 is an explanatory diagram illustrating an example in the case of correcting the lateral registration according to the embodiment of the present invention.

In FIG. 8, predetermined amount of drive is ended, and the lateral shift drive motor M1 performs stop stable operation. In addition, at the time of moving from FIG. 7 to FIG. 8, the sheet is set in a state of being skew-fed from a sheet P11 to a sheet P12 by performing sheet conveyance in the conveying direction and further performing lateral shift operation in the lateral direction orthogonal to the conveying direction.

Figure 9:
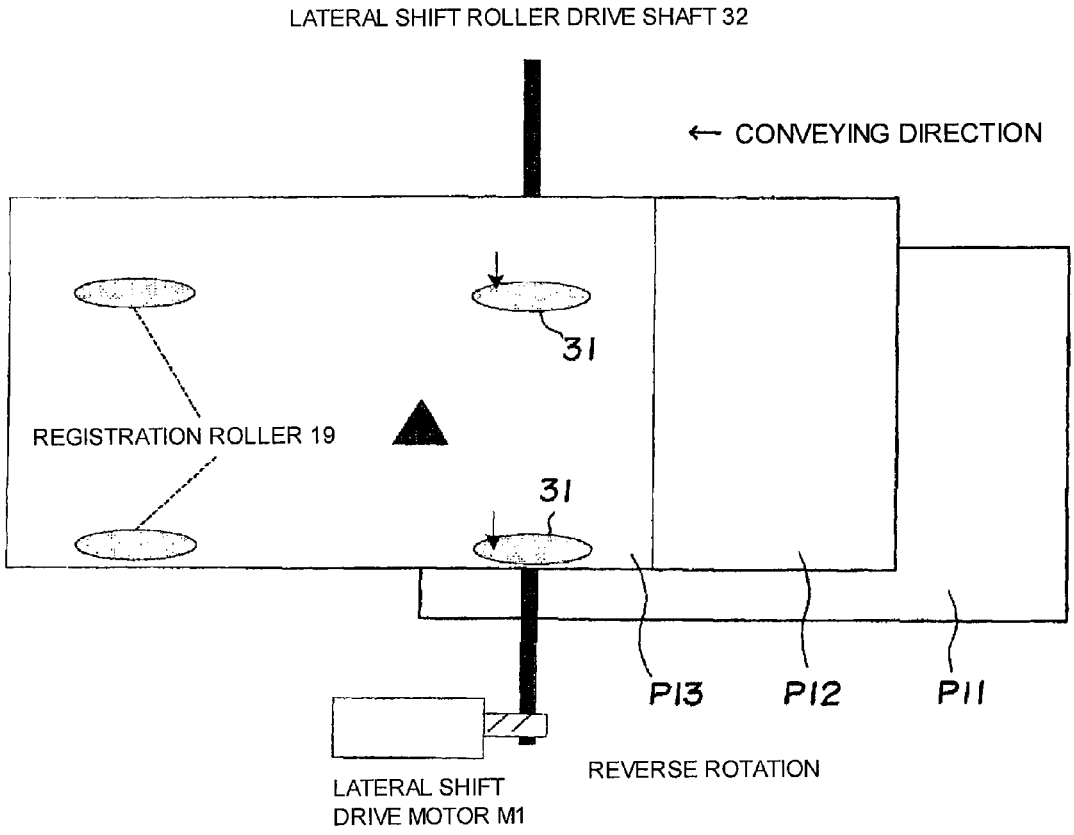
FIG. 9 is an explanatory diagram illustrating an example of the operation in the case of correcting the lateral registration according to the embodiment of the present invention.

Then, in FIG. 9, in order to receive the sheet at the home position of the lateral shift of the next sheet (position of FIG. 7), movement of the lateral shift rollers 31 is started to the lateral shift home position during sheet conveyance. In the example of FIG. 9, the lateral shift drive motor M1 is reversely rotated to move the lateral shift rollers 31 in a direction illustrated by arrow. At this time, the sheet is conveyed by the pair of registration rollers 19 on the lower stream side and the lateral shift rollers 31 are set in a state of not nipping the sheet between them. Therefore, the lateral shift of the sheet does not occur even if the lateral shift is performed, and the sheet is conveyed in the sheet conveying direction and set in a state of a sheet P13.

Figure 10A:
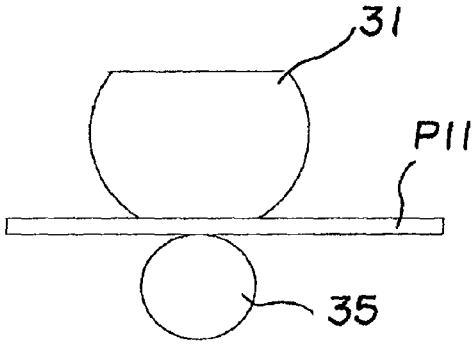
FIGS. 10A and 10B are explanatory diagrams illustrating an example of a sectional view of a lateral shift roller according to the embodiment of the present invention.
Figure 10B:
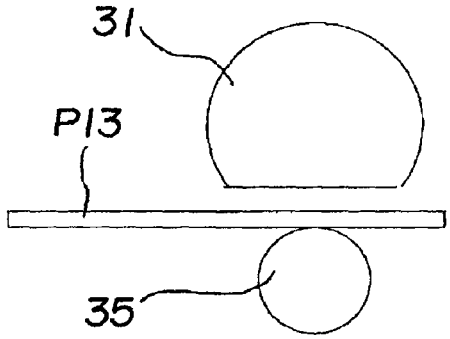
Figure 11A:
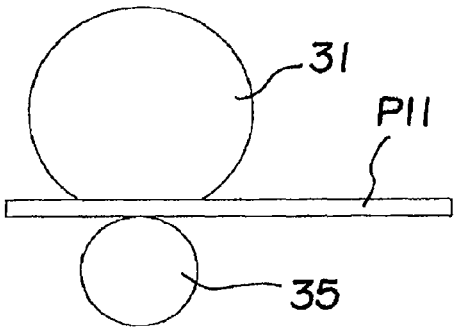
FIGS. 11A and 11B are explanatory diagrams illustrating an example of the sectional view of the lateral shift roller according to the embodiment of the present invention.
Figure 11B:
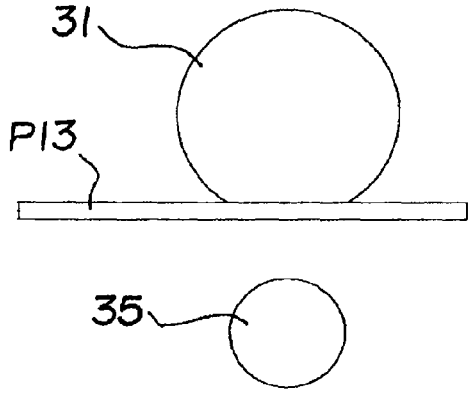

As a state of not nipping the sheet between rollers, as illustrated in FIG. 10A and FIG. 10B, the lateral shift rollers 31 are constituted of the rollers with partially notched (D-cut roller). Then, as illustrated in FIG. 10B, by making a part of the roller in a state of not nipping the sheet, the lateral shift rollers 31 can return to the home position with no influence added to the sheet. In addition, as other structure, as illustrated in FIG. 11A and FIG. 11B, a roller 35 for pressing the sheet against each lateral shift roller 31 is made movable vertically. Then, as illustrated in FIG. 11B, by moving the roller 35 downward, the lateral shift rollers 31 can return to the home position with no influence added to the sheet.

As described above, by operating the lateral shift drive motor M1 in such a manner as positive rotation—stop—reverse rotation (=lateral shift executing operation), the lateral shift correcting operation can be sequentially performed.

Figure 12:
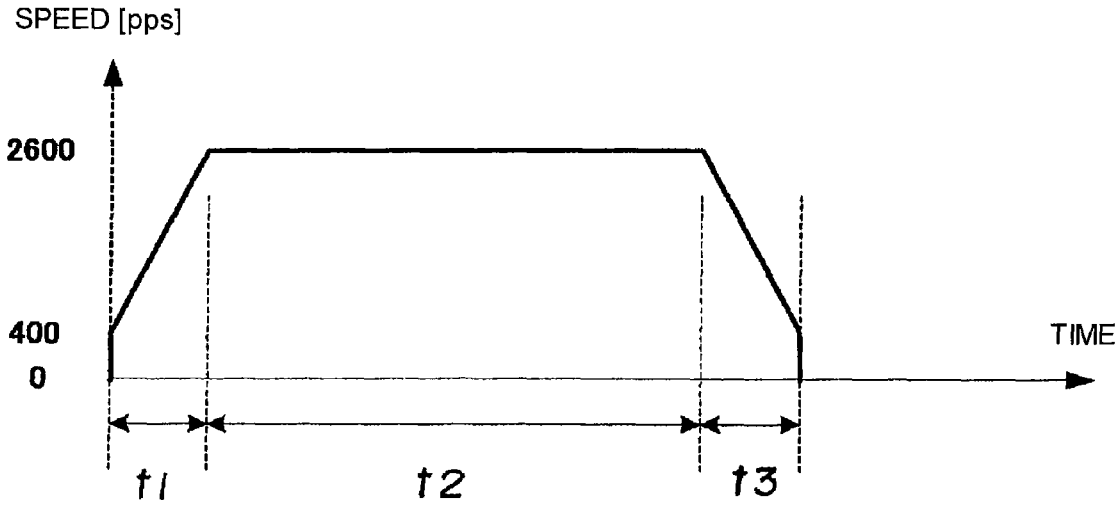
FIG. 12 is an explanatory diagram illustrating an example of a drive line view of a lateral shift drive motor according to the embodiment of the present invention.
Figure 13:
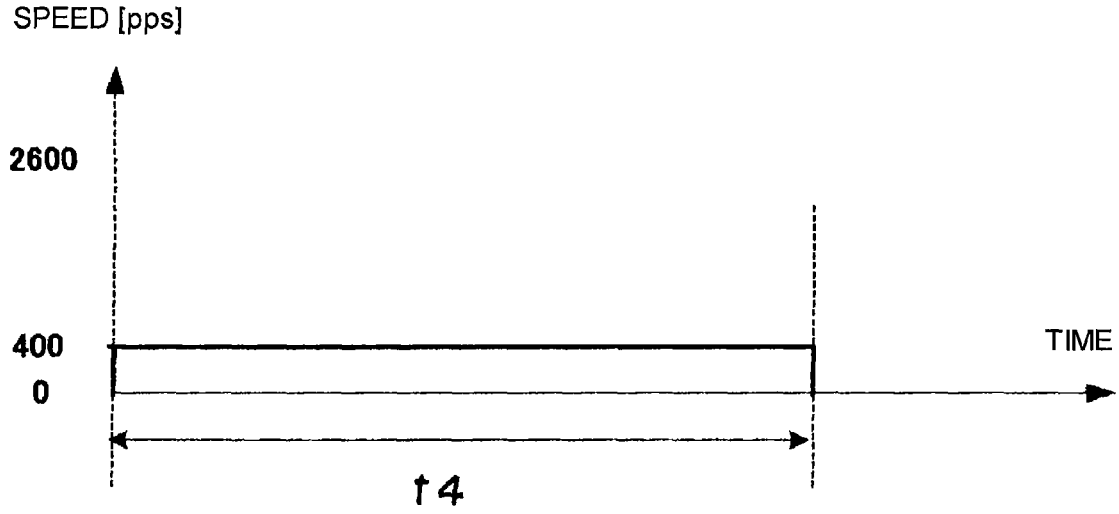
FIG. 13 is an explanatory diagram illustrating an example of the drive line view of the lateral shift drive motor according to the embodiment of the present invention.

In addition, as illustrated in FIG. 12, there are two cases such as a case in which the lateral shift drive motor M1 can perform acceleration and deceleration, and a case in which the lateral shift drive motor M1 can not perform them, depending on lateral registration correction driving amounts. When a relation is not established such as:

(acceleration duration $t1$+deceleration duration $t3$)<
(lateral registration correction driving amount), as illustrated in FIG. 13, self-actuating drive is performed. Lateral shift moving time is shorter in the case of performing acceleration than the case of not performing acceleration, when there is two cases such as the case in which the acceleration can be performed and the case in which the acceleration can not be performed.

[Lateral Registration Shift Control]

Figure 14:
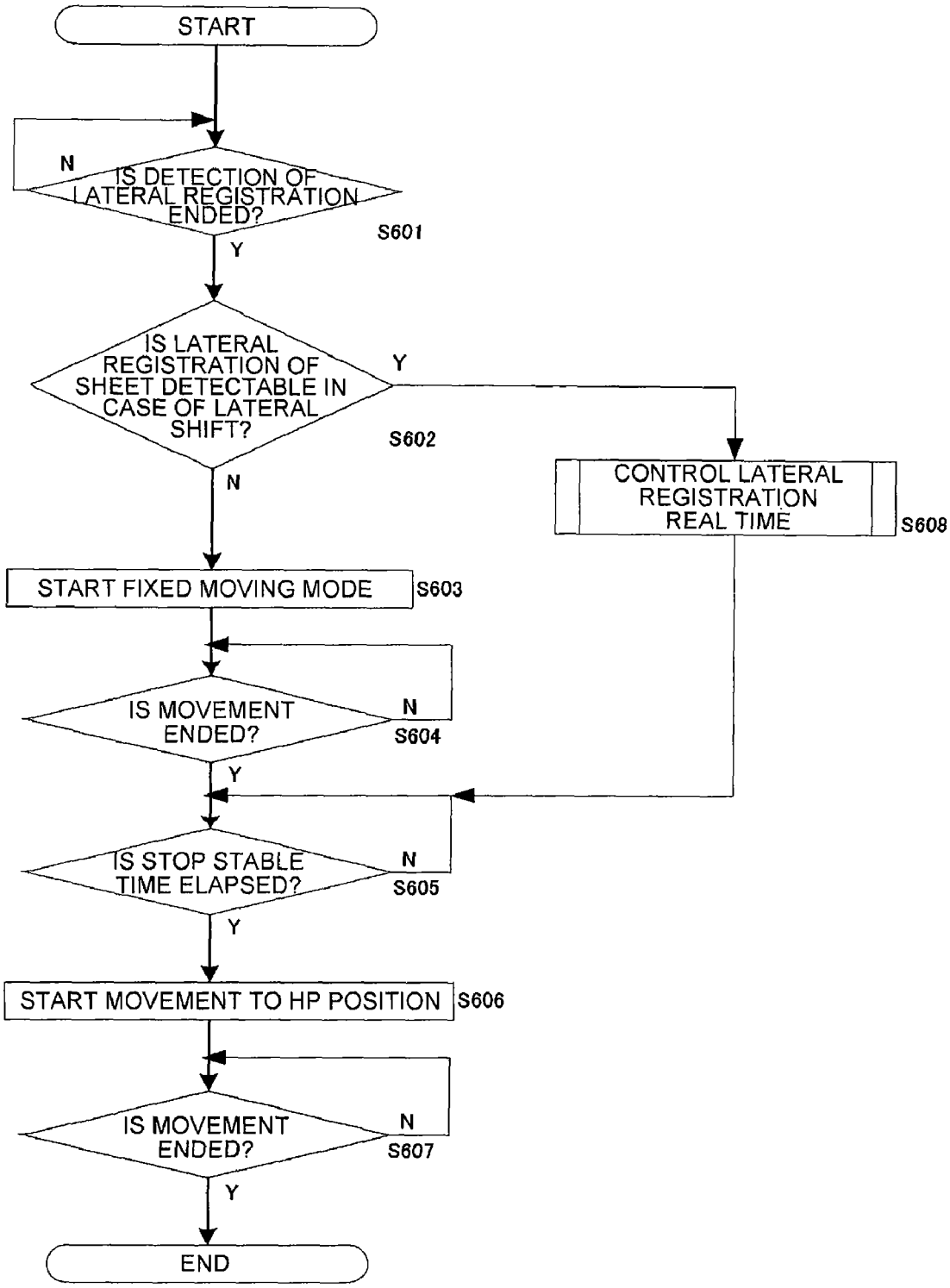
FIG. 14 is a main flowchart according to the embodiment of the present invention.

Next, "lateral registration shift operation control" in the sheet conveying apparatus according to this embodiment is described by using the flowchart of FIG. 14.

In this embodiment, when the detection for the second time is possible by the lateral registration detecting sensor S2 at the time when the lateral shift operation is ended by the above lateral shift part under the control of the control part, the detection of the lateral registration is performed again by the lateral registration detection part. Then, based on a detection result thereof, shift control is performed again so that the conveyed sheet is shifted again in the lateral direction.

First in step S601, it is determined whether or not the lateral registration detection is ended by the above lateral registration detecting sensor S2. When it is so determined that the detection of the lateral registration by the lateral registration detecting sensor S2 is ended in the step S601, the processing proceeds to step S602, and it is determined whether or not the detection of the lateral registration of the sheet for the second time is possible during lateral shift operation.

When time from the start of rotation of the lateral shift drive motor M1 for the lateral shift up to stop of the rotation is set at Ts[s], distance from the lateral shift start sensor S4 to the lateral registration detecting sensor S2 is set at Ss[mm], a sheet size length is set at Sp[mm], a sheet lateral registration start delay time is set at T[s], a sheet conveying speed is set at Vp[mm/s], and lateral registration detecting time is set at Tc[s], it is possible to calculate the possibility of the detection of the lateral registration of the sheet for the second time, by the following formula.

$$Ts<((Sp-Ss)/Vp)-T-Tc$$

When the formula is satisfied, it is so determined in step S602 that the detection of the lateral registration for the second time is possible. Namely, the detection of the lateral registration for the second time is possible, when a sheet rear tip is not passed through the position of the lateral registration detecting sensor S2, at the time of end of the first lateral registration shift operation.

Note that the time Ts from start of the rotation of the lateral shift drive motor M1 for the lateral shift up to stop of the rotation is calculated and obtained from (acceleration time t1)+(constant speed time t2)+(deceleration time t3), as illustrated in FIG. 12, according to the detected lateral shift amount, when the acceleration of the lateral shift drive motor M1 is possible.

Figure 15:
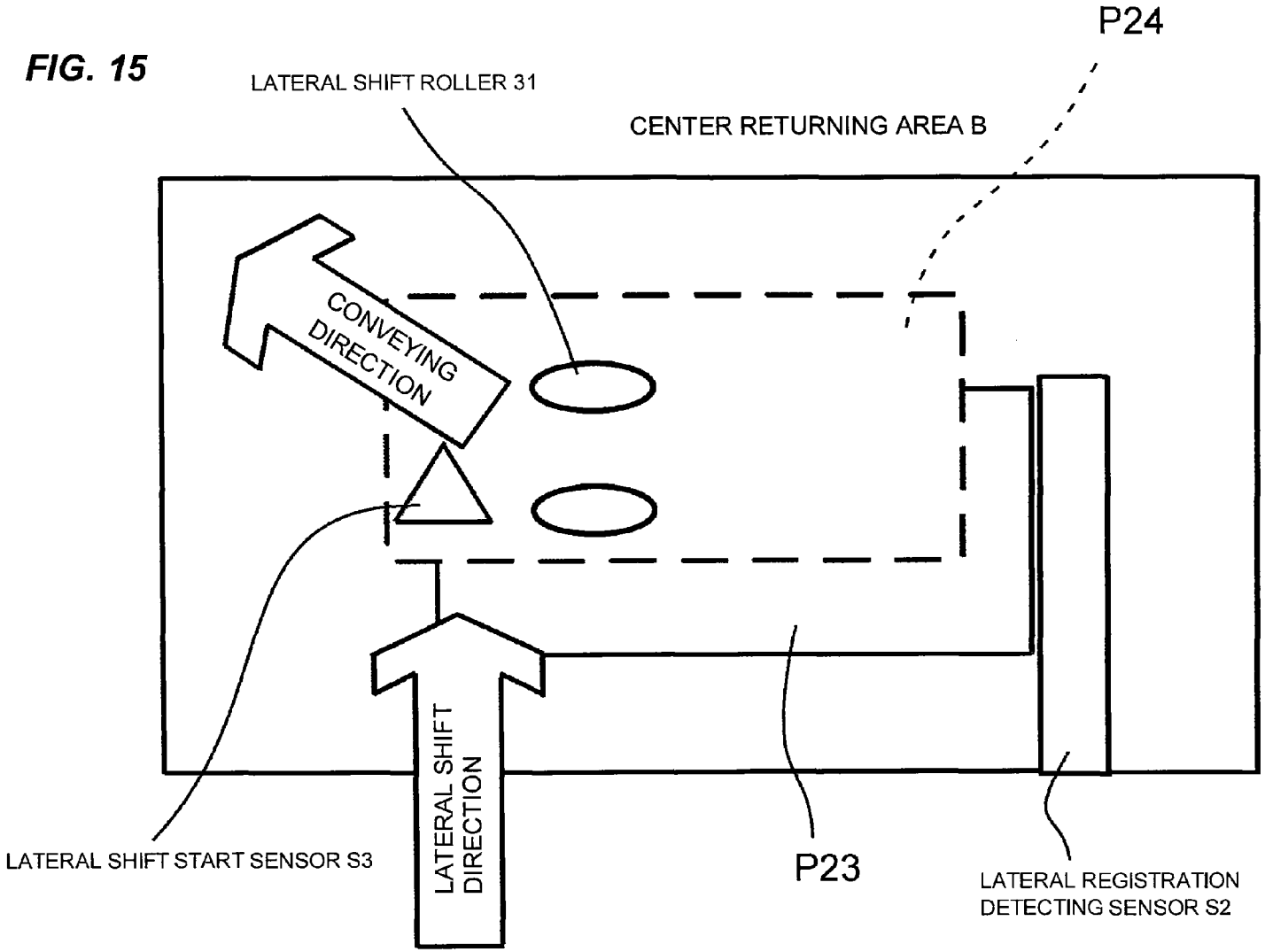
FIG. 15 is a status view, in which the rear tip of the sheet passes through a lateral registration detecting sensor after correcting the lateral registration according to the embodiment of the present invention.

Here, a state in which the detection of the lateral registration is possible and a state in which the detection of the lateral registration is not possible will be described by using FIG. 4 and FIG. 15. FIG. 4 and FIG. 15 show the difference of the lateral registration shift operation in the case of a different sheet size in the center returning area B. In the example illustrated in FIG. 4, the lateral registration shift operation is performed for the sheet P3 of a large size, and a result thereof is illustrated in the sheet P4. At this point, the rear tip of the sheet P4 is not passed through the lateral registration detecting sensor S2, thus enabling the detection of the lateral registration of the sheet P4 again, by the lateral registration detecting sensor S2. Meanwhile, in the example illustrated in FIG. 15, the lateral registration shirt operation is performed for a sheet P23 of a small size, and a result thereof is illustrated in a sheet P24. At this point, the rear tip of the sheet P24 escapes from the lateral registration detecting sensor S2. Therefore, it is impossible to perform the detection of the lateral registration of the sheet P24 again by the lateral registration detecting sensor S2.

When it is so determined that the detection of the lateral registration is impossible in step S602, the processing proceeds to step S603, and the lateral shift drive motor M1 is driven to start movement of the lateral shift rollers (=fixed movement mode).

Then, the end of the movement in step S604 is awaited, and next, in step S605, as described above, elapse of the stop stable time of the lateral shift drive motor M1 is awaited. After step S605, as described above, the lateral shift rollers 31 start movement to the home position during sheet conveyance by the pair of registration rollers 19, to receive the next sheet at the home position (the position of FIG. 7). Then, in step S607, the end of the movement is awaited, and the processing of the flowchart is ended.

Meanwhile, in step S602, when it is so determined that the detection of the lateral registration is possible, in step S608, lateral registration real time control as described below is performed, and the processing proceeds to step S605.

(Lateral Registration Real Time Control)

Figure 16:
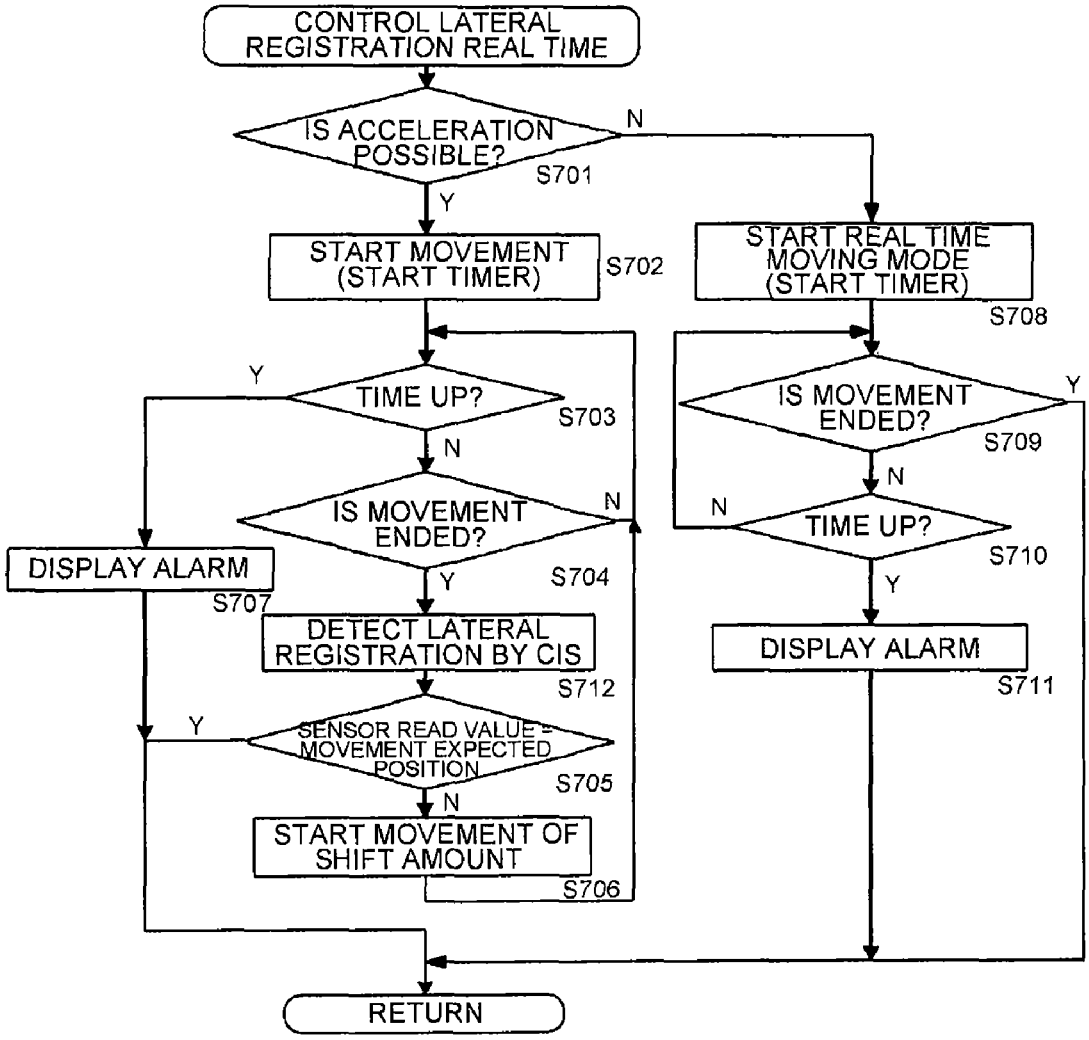
FIG. 16 is a flowchart of a lateral registration real time control according to the embodiment of the present invention.

Next, the above lateral registration real time control will be described by using the flowchart of FIG. 16.

First, in step S701, as illustrated in FIG. 12, the lateral shift drive motor M1 determines whether or not the acceleration can be performed. Determination in step S701 is performed, as described above, by whether or not the relation of (acceleration duration t1+deceleration duration t3)<(lateral registration correction driving amount) is satisfied.

When it is so determined in step S701 that the acceleration is possible, the processing proceeds to step S702, and the drive of the lateral shift drive motor M1 is started. Also, at this time, timers are internally operated for detecting time-out. The time until the detection of the lateral registration of the sheet can not be performed by the lateral registration detecting sensor S2, is set to be a time-out value. Namely, when the time-out value is obtained, this means that the rear tip of the sheet escapes from the lateral registration detecting sensor S2.

The processing proceeds from step S702 to step S703, and whether or not the timers obtain the time-out values is determined. When it is so determined in step S703 that the timers do not obtain the time-out values, the processing proceeds to step S704, and it is determined whether or not the movement of the lateral shift rollers 31 by the drive of the lateral shift drive motor M1 is ended.

When it is so determined in step S704 that the movement of the lateral shift rollers 31 by the drive of the lateral shift drive motor M1 is not ended, the processing is returned to step S703. Reversely, when it is so determined that the movement of the lateral shift rollers 31 by the drive of the lateral shift drive motor M1 is ended, the processing proceeds to step S712, and the detection of the lateral registration of the sheet is performed again by the lateral registration detecting sensor S2.

The processing proceeds from step S712 to step S705, and it is determined whether or not a lateral registration amount detected in step S712 achieves a lateral registration ideal position (lateral registration reference position) illustrated in FIG. 5.

When it is so determined in step S705 that the detected lateral registration amount achieves the lateral registration ideal position, the lateral registration real time control is escaped. Reversely, when it is so determined in step S705 that the detected lateral registration amount does not achieve the lateral registration ideal position, the shift amount of the lateral registration is set as a moving amount of the lateral shift rollers 31 driven by the lateral shift drive motor M1, and the movement is started. Then, the processing is returned to step S703.

Figure 17:
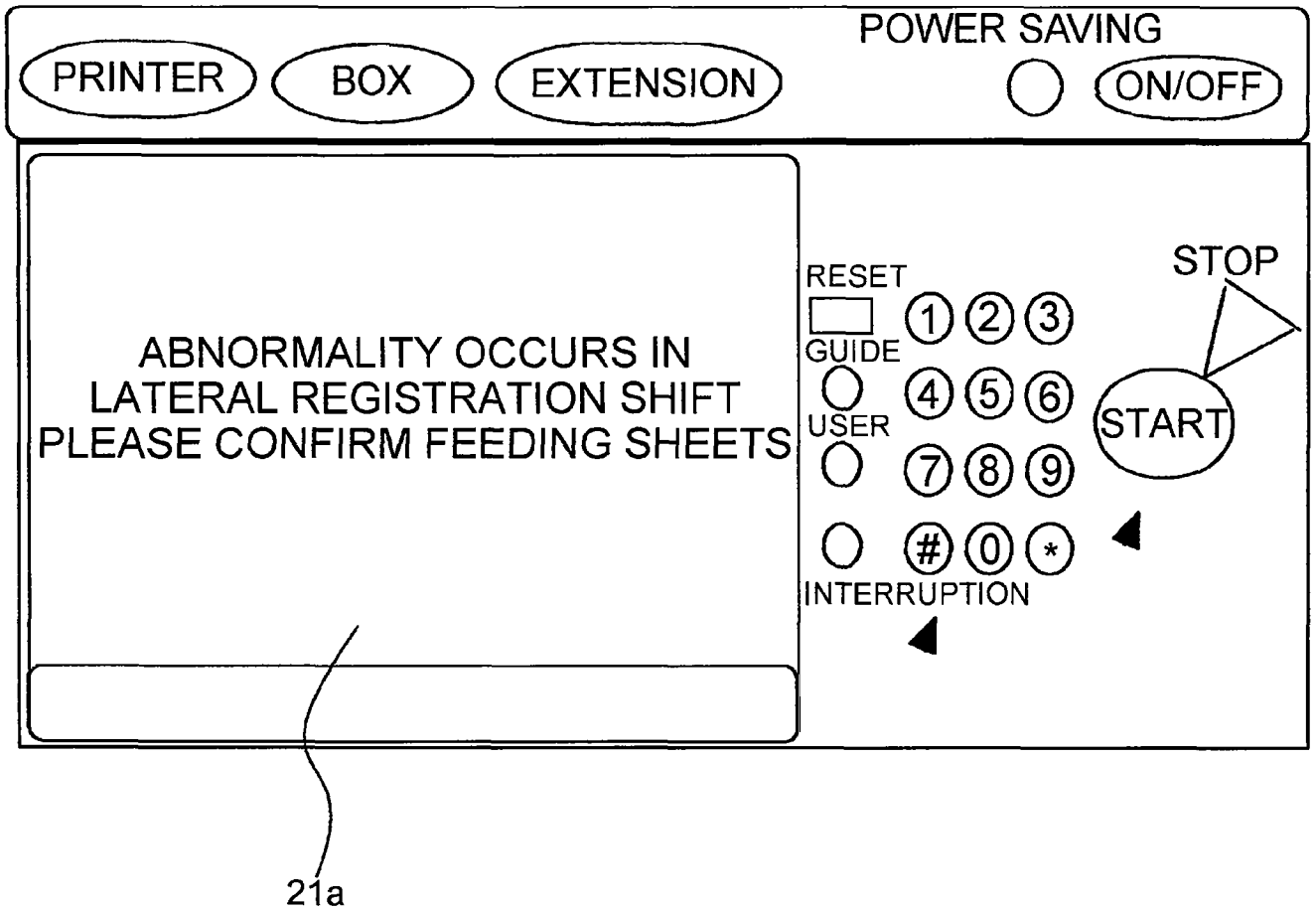
FIG. 17 is an explanatory diagram of displaying abnormality in an operation portion according to the embodiment of the present invention.

In addition, when it is so determined in step S703 that the timers obtain time-out, the processing proceeds to step S707, and as illustrated in FIG. 17, the display part 21*a* displays a message that there is abnormality in the lateral registration shift part, to escape the lateral registration real time control. Namely, when a first lateral shift is not ended by the lateral shift rollers 31 within a predetermined time set by the timers, the lateral shift operation is not performed again and the display part 21*a* displays the message.

Figure 18:
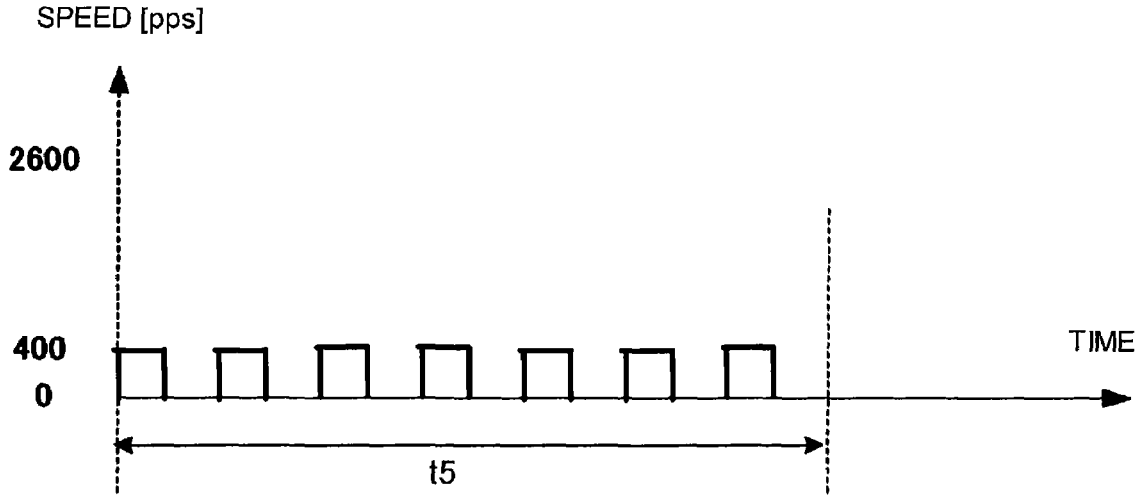
FIG. 18 is an explanatory diagram illustrating an example of a driving line view of a lateral shift drive motor according to the embodiment of the present invention.
Figure 19:
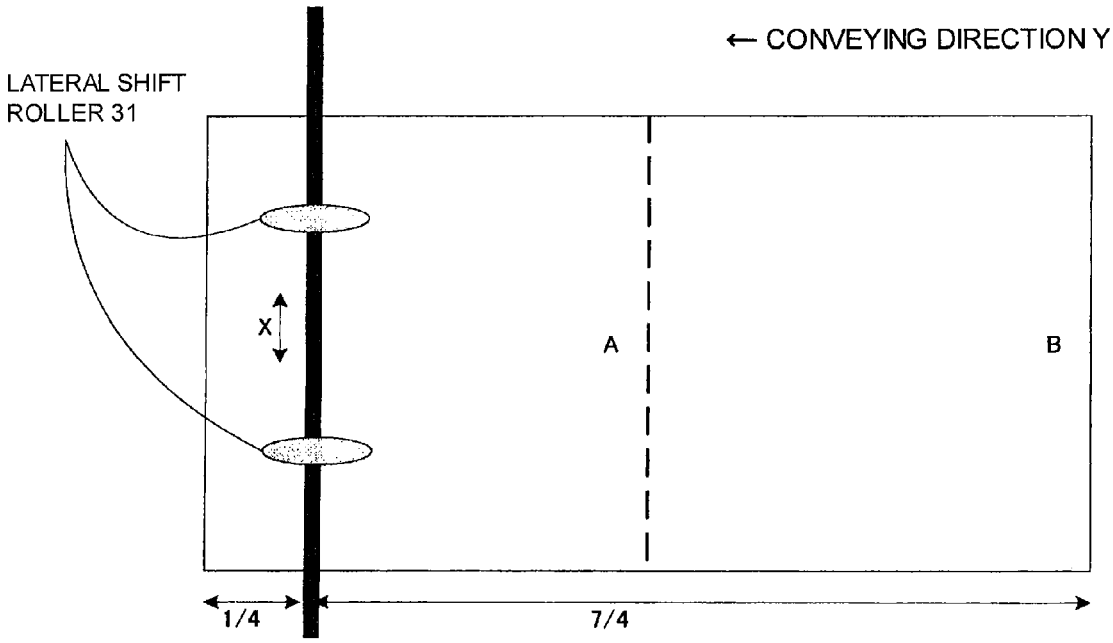
FIG. 19 is a schematic view of correction of the lateral registration.

In addition, when it is so determined in step S701 that the acceleration is impossible, the processing proceeds to step S708, and as illustrated in FIG. 13, the drive of the lateral shift drive motor M1 is started by self-activation. As a driving method, it is possible to select either case of a case in which the lateral shift drive motor M1 is driven at a constant speed as illustrated in FIG. 13 and a case in which a driving pulse is output one by one as illustrated in FIG. 18. However, in step S708, the detection of the lateral registration of the sheet is performed by the lateral registration detecting sensor S2 every other pulse, because the lateral shift drive motor M1 is driven by self-activation, and it is determined in step S709 whether or not the detected lateral registration amount achieves the above lateral registration ideal position.

The case of FIG. 13 is different from the case of FIG. 18, in the point that when the time for performing the detection of the lateral registration of the sheet by the lateral registration detecting sensor S2 is shorter than a self-activating frequency of the lateral shift drive motor M1, as illustrated in FIG. 13, the lateral shift drive motor M1 is driven at a constant speed. Reversely, when the time for performing the lateral registration detection by the lateral registration detecting sensor S2 is longer than the self-activating frequency of the lateral shift drive motor M1, the next driving pulse is output by the lateral shift drive motor M1 while the detection of the lateral registration of the sheet is performed by the lateral registration detecting sensor S2. Therefore, as illustrated in FIG. 18, control is performed so that the driving pulse is output and stopped one by one, and the next pulse is output after the detection of the lateral registration of the sheet is completed by the lateral registration detecting sensor S2. In addition, in step S708, in the same way as the step S702, the timers are internally operated for detecting time-out. The reason therefore is the same as the case of the step S702.

Next, when it is so determined in step S709 that the detected lateral registration amount does not achieve the above lateral registration ideal position, the processing proceeds to step S710, and whether or not the timers obtain time-out is determined. When it is so determined in step S710 that the timers do not obtain time-out, the processing is returned to step S709.

Also, reversely, when it is so determined in step S710 that the timers obtain time-out, the processing proceeds to step S711, and in the same way as the step S707, the display part 21*a* displays the message that there is abnormality in the lateral registration shift part, to escape the lateral registration real time control.

In addition, when it is so determined in step S709 that the detected lateral registration amount achieves the above lateral registration ideal position, the lateral registration real time control is escaped.

As described above, by performing the detection of the lateral registration of the sheet before and after moving the lateral shift rollers 31, accuracy of the lateral registration can be improved. Particularly, stable correction of the registration is possible by performing the lateral shift correction again for the sheet having a long sheet feeding length in which fluctuation easily occurs in conveyance.

In addition, in the above embodiment the lateral shift rollers 31 is spaced from the lateral registration detecting sensor S2 so that the lateral shift rollers 31 can shift the sheet after considering the delay time T and etc when the lateral registration detecting sensor S2 can detect the sheet. In above mentioned embodiment, the CPU 501 calculates the possibility of the detection of the lateral registration of the sheet for the second time, by the following formula.

$$Ts<((Sp-Ss)/Vp)-T-Tc$$

However, it can be consisted that the CPU 501 determines that the second operation of the lateral shift rollers 31 is impossible when a amount of the first shift of the lateral shift rollers 31 based on the signal output from the lateral registration detecting sensor S2 is larger than a predetermined amount, and the CPU 501 determines that the second operation of the lateral shift rollers 31 is possible when a amount of the first shift of the lateral shift rollers 31 based on the signal output from the lateral registration detecting sensor S2 is equal or small than the predetermined amount. Here in this embodiment, the ROM 502 memorize the predetermined amount every size of each sheet.

In addition it can be consisted that the shift roller 31 performs the first shift operation at a high speed, and the first the shift roller 31 performs the second shift operation at a low speed. In this case, because the second shift operation is performed at the low speed, the precision of the shift of the sheet is improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-305590, filed Nov. 27, 2007, which is hereby incorporated by reference herein in its entirety.

What is claimed is:

1. A sheet conveying apparatus, comprising:

a sheet conveying part that conveys sheets;

a detection part that outputs a signal according to a position of each sheet conveyed by the sheet conveying part in a lateral direction orthogonal to a conveying direction;

a lateral shift part that shifts the conveyed sheet in the lateral direction; and a control part that controls an operation of the lateral shift part based on an output of the detection part, wherein after a lateral shift operation is ended by the lateral shift part, a detection is performed again by the detection part, and the control part controls the operation of the lateral shift part based on a detection result thereof, the control part determines whether or not a second operation of the lateral shift part is possible, and the control part determines that the second operation of the lateral shift part is impossible when an amount of the first shift of the lateral shift part based on the signal output from the detection part is larger than a predetermined amount, and the control part determines that the second operation of the lateral shift part is possible when an amount of the first shift of the lateral shift part based on the signal output from the detection part is equal to or smaller than the predetermined amount.

2. The sheet conveying apparatus according to claim 1, wherein under control of the control part, when it is so determined that the detection for the second time is possible by the detection part, and a first lateral shift is not ended by the lateral shift part within a predetermined time, a display part displays the message without performing a lateral shift operation again.

3. The sheet conveying apparatus according to claim 1, wherein the control part determines so that the second operation of the lateral shift part is possible when a rear tip of a conveyed sheet is not passed through a detection position detected by the detection part at a point when the lateral shift operation is ended by the lateral shift part.

4. The sheet conveying apparatus according to claim 1, wherein the control part determines whether or not the operation of the lateral shift part for the second time is possible based on the signal which the detection part first outputs.

5. A sheet conveying apparatus, comprising:

a sheet conveying part that conveys sheets;

a detection part that outputs a signal according to a position of each sheet conveyed by the sheet conveying part in a lateral direction orthogonal to a conveying direction;

a lateral shift part that shifts the conveyed sheet in the lateral direction; and a control part that controls an operation of the lateral shift part based on an output of the detection part, wherein after a lateral shift operation is ended by the lateral shift part, a detection is performed again by the detection part, and the control part controls the operation of the lateral shift part based on a detection result thereof, the control part determines whether or not the operation of the lateral shift part is possible a second time, and the control part so determines that the detection for the second time is possible by the detection part, when a time for making the lateral shift part perform a lateral shift based on a detection result of the detection part is set at Ts[s], a time from detecting a tip of a conveyed sheet by a lateral shift start detection part up to start of lateral shift of the lateral shift part is set at T[s], distance from the lateral shift start detection part to the detection part is set at Ss[mm], a size length of the conveyed sheet is set at Sp[mm], a sheet conveying speed is set at Vp[mm/s], and detecting time by the detection part is set at Tc[s], satisfying a relation expressed by $$Ts<((Sp-Ss)/Vp)-T-Tc.$$

6. The sheet conveying apparatus according to claim 5, wherein under control of the control part, when it is so determined that the detection for the second time is possible by the detection part, and a first lateral shift is not ended by the lateral shift part within a predetermined time, a display part displays the message without performing a lateral shift operation again.

7. The sheet conveying apparatus according to claim 5, wherein the control part determines so that the second operation of the lateral shift part is possible when a rear tip of a conveyed sheet is not passed through a detection position detected by the detection part at a point when the lateral shift operation is ended by the lateral shift part.

8. The sheet conveying apparatus according to claim 5, wherein the control part determines whether or not the operation of the lateral shift part for the second time is possible based on the signal which the detection part first outputs.

* * * * *